US006836990B2

(12) United States Patent
Shiloni

(10) Patent No.: US 6,836,990 B2
(45) Date of Patent: Jan. 4, 2005

(54) HANDGUARD FOR A RIFLE

(75) Inventor: Amnon Shiloni, Shoam (IL)

(73) Assignee: First Samco, Inc., Southampton, PA (US)

( * ) Notice: Subject to any disclaimer, the term of this patent is extended or adjusted under 35 U.S.C. 154(b) by 2 days.

(21) Appl. No.: 10/700,418

(22) Filed: Nov. 4, 2003

(65) Prior Publication Data

US 2004/0226212 A1 Nov. 18, 2004

(51) Int. Cl.[7] ..... F41A 35/02
(52) U.S. Cl. ..... 42/96; 42/75.02
(58) Field of Search ..... 42/96, 112, 143, 42/83, 124, 75.02, 71.01

(56) References Cited

U.S. PATENT DOCUMENTS

| | | | | |
|---|---|---|---|---|
| 859,932 A | | 7/1907 | Edwards | |
| 1,037,486 A | | 9/1912 | Johnson | |
| 2,312,150 A | | 2/1943 | Conner | 42/75 |
| 2,674,822 A | | 4/1954 | Studler | 42/71 |
| 2,965,994 A | | 12/1960 | Sullivan | 42/71 |
| 2,981,154 A | * | 4/1961 | Sweeney | 89/14.5 |
| 3,090,150 A | * | 5/1963 | Stoner | 42/71.01 |
| 3,641,691 A | | 2/1972 | Ellis et al. | 42/1 F |
| 4,536,982 A | * | 8/1985 | Bredbury et al. | 42/71.01 |
| 4,663,875 A | | 5/1987 | Tatro | 42/71.01 |
| 4,733,489 A | | 3/1988 | Kurak | 42/77 |
| D300,161 S | | 3/1989 | Baldus et al. | D22/108 |
| 5,010,676 A | | 4/1991 | Kennedy | 42/71.01 |
| 5,103,714 A | | 4/1992 | LaFrance | 89/129.01 |
| 5,198,600 A | | 3/1993 | E'Nama | 42/90 |
| 5,343,650 A | | 9/1994 | Swan | 42/100 |
| 5,590,484 A | | 1/1997 | Mooney et al. | 42/100 |
| 5,826,363 A | | 10/1998 | Olson | 42/75.01 |
| 5,930,935 A | | 8/1999 | Griffin | 42/105 |
| 6,134,823 A | | 10/2000 | Griffin | 42/105 |
| 6,293,040 B1 | | 9/2001 | Luth | 42/75.01 |
| 6,381,895 B1 | | 5/2002 | Keeney et al. | 42/124 |
| 6,449,893 B2 | * | 9/2002 | Spinner | 42/127 |
| 6,609,321 B2 | * | 8/2003 | Faifer | 42/71.01 |

FOREIGN PATENT DOCUMENTS

DE 4009012 A 9/1991

OTHER PUBLICATIONS

U.S. Appl. No. 29/181,026, filed May 2, 2003, Shiloni.
U.S. Appl. No. 29/157,270, filed Mar. 14, 2002, Faifer.

* cited by examiner

*Primary Examiner*—Stephen M. Johnson
(74) *Attorney, Agent, or Firm*—Drinker Biddle & Reath LLP

(57) ABSTRACT

A preferred handguard for a rifle includes a pair of essentially identical half-grip pieces each having an elongated body with a generally triangular lateral cross-section, including two exterior sides and a mating side. The exterior sides of the triangular cross-section are formed substantially at a right angle to each other. The mating side of the triangular cross-section is centrally hollowed and has outer edges that form a mating surface for mating with the other half-grip piece to enclose an air space surrounding a section of the rifle barrel. Longitudinally extending accessory mounting rails are formed on each of the exterior sides and are recessed in the half-grip piece such that the rails are located inside a laterally extended generally semi-octagonal outline defined by an end wall. Removable elastomeric rail covers that replicate the semi-octagonal outline are provided to form a substantially continuous shape with the end wall.

21 Claims, 8 Drawing Sheets

HANDGUARD FOR A RIFLE

RELATED PATENTS-CLAIM OF FOREIGN PRIORITY

This application claims the priority of Israel Design Patent Application No. 37166, filed Nov. 4, 2002, titled "HAND GUARD INCLUDING PICATINNY RAILS FOR A LONG M16 RIFLE"; Israel Design Patent Application No. 37167, filed Nov. 4, 2002, titled "HAND GUARD INCLUDING PICATINNY RAILS FOR A SHORT M16 RIFLE"; Israel Design Patent Application No. 37168, filed Nov. 4, 2002, titled "HAND GUARD INCLUDING A HEAT SHIELD AND PICATINNY RAILS FOR A LONG M16 RIFLE, AND ELASTOMERIC COVERS FOR THE RAILS"; and Israel Design Patent Application No. 37169, filed Nov. 4, 2002, titled "HAND GUARD INCLUDING A HEAT SHIELD AND PICATINNY RAILS FOR A SHORT M16 RIFLE, AND ELASTOMERIC COVERS FOR THE RAILS".

FIELD OF THE INVENTION

This invention is related to the general field of forearm handguards for firearms, and to the particular field of forearm handguards for high rate of fire tactical rifles and carbines such as the M16/AR15 family.

BACKGROUND

Tactical shoulder rifles enable rapid high-volume fire that can heat the rifle barrel to very high temperatures. To protect the rifleman against contact with the hot surface, and to help dissipate the heat, the barrel is usually shrouded by a handguard or grip that completely encloses the portion of the barrel directly in front of the receiver over a length sufficient to provide a grip area for the rifleman's lead hand. This type of forearm handguard is usually "free-floating", i.e. connected to the rifle only at end-cap fittings and not directly in contact with the barrel. The handguard thus creates an air space around the barrel to retard heat conduction from the barrel into the handguard. The handguard is vented with air holes or slots to allow heat convection out of the enclosed air space. An early example of this type handguard is described in U.S. Pat. No. 2,965,994. The handguard described in this reference has a laminated construction, comprising a fiberglass-reinforced plastic outer skin laminated to a low-density foam core, with the inner surface covered by a reflecting foil.

Forearm handguards can have a generally triangular or pear-like sectional shape wherein the base is wider and more flat than the top, as in the earlier versions of M16. This configuration provides a wider support area for the palm when firing offhand, and a more stable platform when firing over a rest, than would a handguard with a narrow bottom. However, there are advantages to a generally cylindrical handguard wherein the top and bottom pieces are identical mating semi-oval half-pieces, such as described in U.S. Pat. Nos. 4,536,982 and 4,663,875. In such handguards, the area at the center of the half pieces (top and bottom of the assembled handguard) is a flat longitudinal rib with a row of vent holes. The exterior of the top and bottom half-pieces described in U.S. Pat. No. 4,536,982 have laterally extending ribs over most of the surface to enhance structural integrity and provide a firm grip, while the flat longitudinal rib has small longitudinal grooves, perhaps to improve the rest characteristic.

It is also known to attach one or more rail adapters to or along a forearm handguard to mount various accessories to the rifle, as described in U.S. Pat. Nos. 5,826,363; 5,590,484 and 5,198,600. When an adapter rail is not being used, it can be protected by covering it with a panel that slides along the grooves at the sides of the rail, as shown in the above U.S. Pat. No. 5,826,363.

Recent improvements in handguard technology are disclosed in commonly owned U.S. Pat. No. 6,609,321. The handguard is lightweight and easily assembled, combining several features shown in the above references, with improvements in how the features are interrelated. In particular, the handguard is made of two injection-molded plastic half-grip pieces, at least one of which has an integrally-molded accessory rail that it is recessed in the area at the center of the half-grip piece. This recessed positioning locates the ribs and guide channel of the rail inside what would be the extended arc of the sides of the half-grip piece in the traditional handguard of this type. A rail cover is provided that replicates the extended arc of the sides of the half-grip piece up to a flat longitudinally extending rib along the center of the cover. Thus, with the cover installed, the grip has essentially the same feel and dimensions as the traditional oval grip as described and shown in U.S. Pat. Nos. 4,536,982 and 4,663,875. Vent holes may be positioned between the opposing ribs of the rail, and the cover may have matching vent holes in registry with the holes between the rails.

BRIEF SUMMARY OF THE INVENTION

The handguard of the present invention includes first and second mating half-grip pieces. Preferably, the first and second half-grip pieces are substantially identical. At least the first half-grip piece includes an elongated body having a generally triangular lateral cross-section with two exterior sides and a mating side. The exterior sides of the triangular cross-section are formed substantially at a right angle to each other. The mating side of the triangular cross-section is centrally hollowed and has outer edges that form a mating surface for mating with the other half-grip piece to enclose an air space surrounding a section of the rifle barrel between the receiver and the front-sight/gas return tube assembly.

At least the first half-grip piece has a longitudinally extending accessory mounting rail formed on each of the exterior sides substantially at right angles to each other and recessed in the half-grip piece such that the rails are located inside a laterally extended generally semi-octagonal outline that can be defined by an end wall of the half-grip piece.

The half-grip pieces have a semicircular opening for wrapping around the barrel of the firearm and at least the first grip piece has a slot extending from the semi-circular opening for receiving the gas return tube of the firearm. The slot projects from the semicircular opening at a substantially right angle to one of the exterior sides. When the half-grip pieces are assembled, the semicircular openings mate to form a substantially circular opening. The half-grip pieces are formed so that the handguard has a mounting apparatus surrounding the circular opening. The mounting apparatus includes a ring with a generally hexagonal outer shape and at least two, and preferably six, semi-arcuate engagement tabs disposed about the ring so that the apparatus can engage either a triangular front handguard retaining ring or a circular front handguard retaining ring.

At least the first half-grip piece can also include a cover for each accessory mounting rail. The covers are adapted to cover the rails when the rails are not in use. When engaged with the rails, the covers and exposed surface of the body define a generally semi-octagonal outer shape that is substantially continuous with that defined by the end wall.

The first half-grip piece is described below in more detail as the top-left half-grip piece. It has already been noted that the two pieces are preferably substantially identical. However, in the event that the first and second half-grip pieces are not substantially identical, the half-grip piece described in detail below could instead be the bottom-right half grip piece, and the top-left could be different. It is also possible to form mirror images of the piece described herein.

DESCRIPTION OF THE PREFERRED EMBODIMENTS

Figure 1:
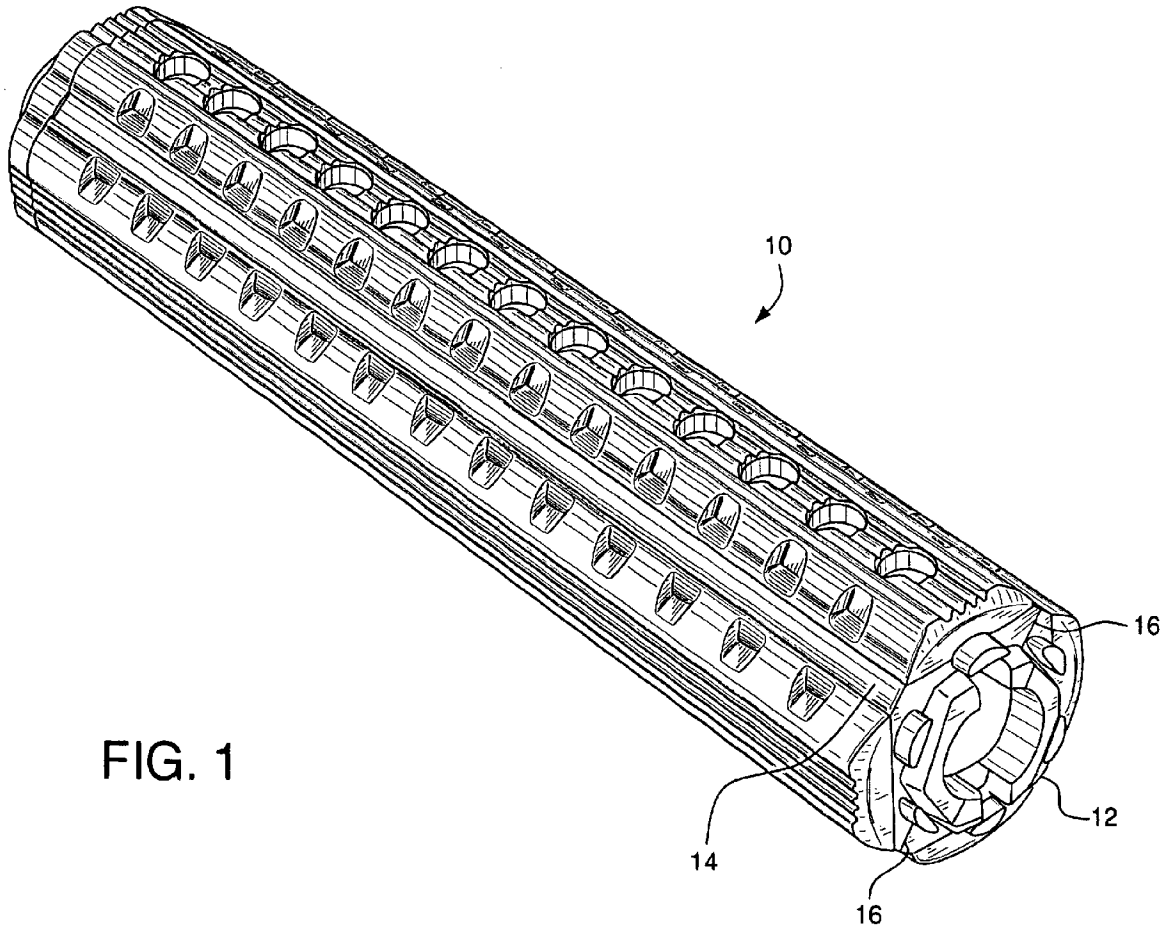
FIG. 1 is a perspective view of the side and front of the exterior of a handguard according to the invention with rail covers installed over the accessory rails.

In the Figures, in which like reference numerals identify like elements, there is shown a handguard 10 for a rifle. The handguard can be used with a rifle of the M16/AR15 family in a manner similar to that shown in the above-referenced U.S. Pat. No. 6,609,321, which is incorporated herein by reference. The length of the handguard 10 can be different from that shown in the drawings to accommodate a variety of rifles with different barrel lengths. Commonly owned U.S. Design Pat. App. No. 29/181,026, which is incorporated herein by reference, shows handguards for both a long rifle and a short rifle.

The handguard 10 is made of two half-grip pieces, shown as a bottom-right half piece 12 and a top-left half-grip piece 14, which are mated together along mating surfaces 16. It is also possible to configure the handguard as a mirror image of that shown in the drawings, in which case the handguard would have a top-right half grip piece and a bottom-left half-grip piece (not shown). The half-grip pieces include an elongated body formed from an injection-molded high density polymer. A preferred material is high temperature nylon reinforced with fiberglass.

Figure 2:
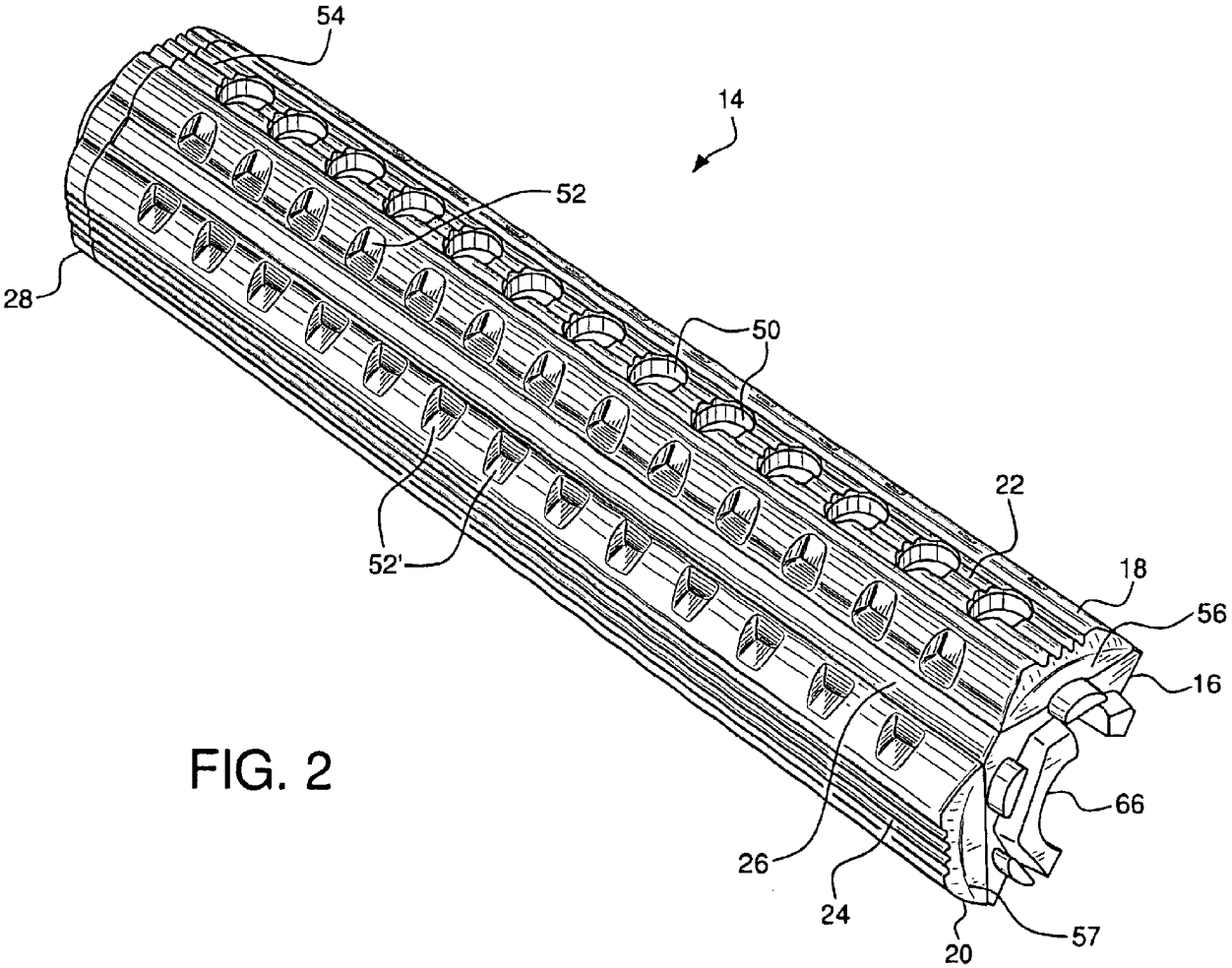
FIG. 2 is a perspective view of a half-grip piece according to the invention with rails covers installed over the accessory rails.

FIG. 2 is a perspective view of the exterior side and front of the top-left half-grip piece 14. The bottom-right half-grip piece 12 is preferably identical, as shown in FIG. 1, so that the pieces can be formed with a common mold. The half-grip piece 14 includes removable covers 18, 20, which are preferably flexible. The removable covers 18, 20, when in place, provide the half-grip piece 14 with an exterior lateral section of a generally semi-octagonal shape, generally flattened at the cover tops 22, 24 and slightly depressed at flattened surface 26 (part of the half-grip piece body) between the covers 18, 20. The terms "lateral" and "laterally", as used herein, refer to directions that are transverse to the longitudinal axis of the elongated body, including left, right, up and down. The half-grip piece 14 further includes an end wall 28 at its rearward end. The end wall 28 defines a generally semi-octagonal exterior shape that is substantially continuous with that defined by the covers 18, 20 and flattened surface 26.

Figure 4:
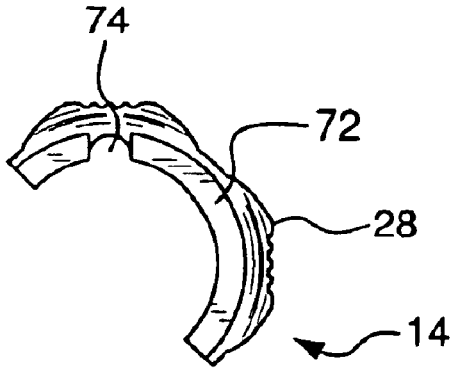
FIG. 4 is a rear plan view of the half-grip piece of FIG. 2.
Figure 5:
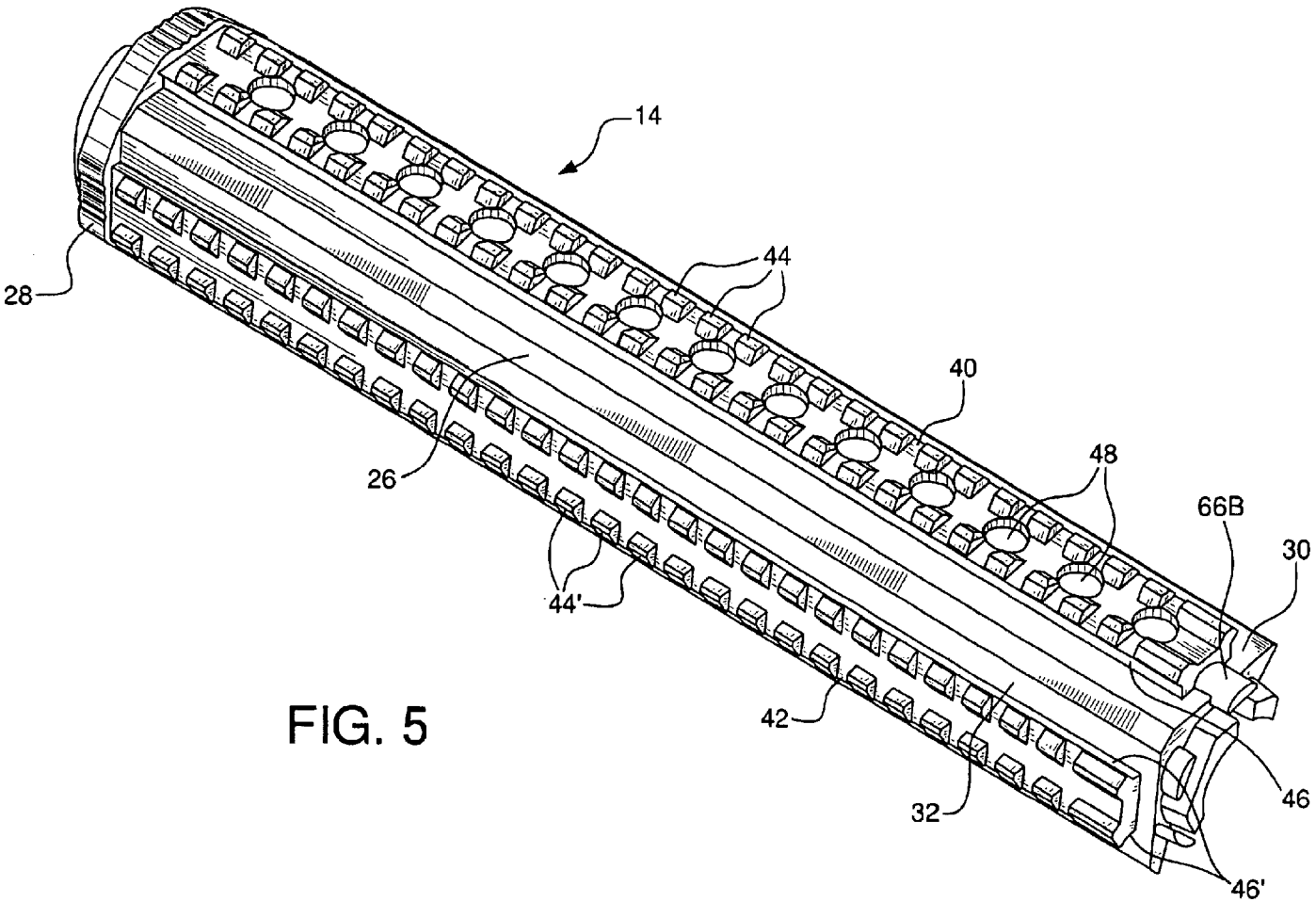
FIG. 5 is a perspective view of the half-grip piece of FIG. 2 with the rail covers removed.
Figure 6:
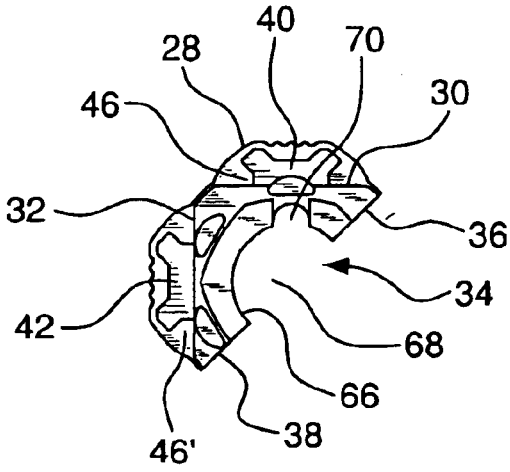
FIG. 6 is a front plan view of the half-grip piece of FIG. 2 with the rail covers removed.
Figure 10:
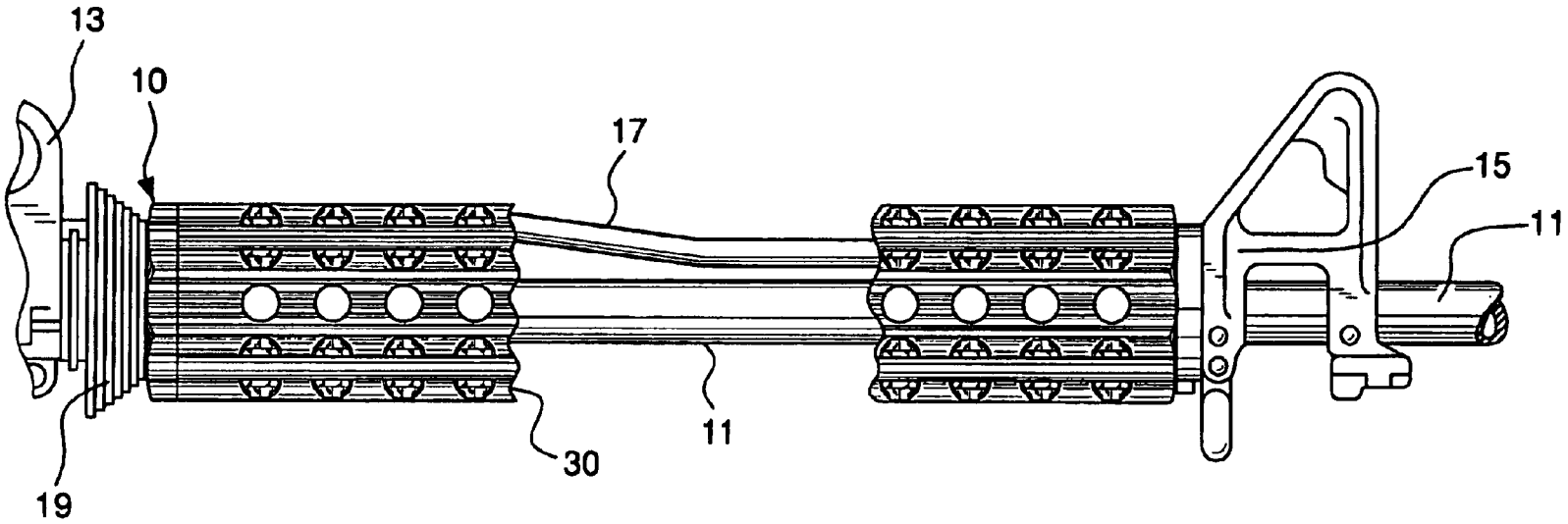
FIG. 10 is a side elevation view of a barrel section of a rifle incorporating a handguard according to the invention, with a portion of the handguard cut away to reveal the barrel and the gas return tube.

FIGS. 5 and 6 show the exterior front and side of the half-grip piece 14 with the covers 18, 20 removed. The back of the piece 14 (FIG. 4) looks the same with the covers engaged and removed. The half-grip piece 14 has an elongated body with a generally triangular lateral cross-section having two shorter exterior sides 30, 32 and a longer mating side 34, the exterior sides 30, 32 of the triangular cross-section being formed substantially at a right angle to each other, the longer side 34 of the triangular cross-section being centrally hollowed and having outer edges 36, 38 that form a mating surface for mating with the other half-grip piece. When the two half-grip pieces are mated, they form the forearm handguard 10, which encloses an air space surrounding a portion of the rifle barrel 11 between the receiver 13 and the front-sight/gas return tube assembly 15, as shown in FIG. 10.

The half-grip piece 14 has a longitudinally extending accessory mounting rail 40, 42 formed in the lateral center of each of the exterior sides 30, 32 thereof. Each of the accessory mounting rails 40, 42 have two rows of opposing posts 44 and a guide channel 46 along and depending under each row. Rails of this type are well known and often identified as Picatinny Rails. Another common accessory rail is the Weaver Rail, which may alternatively be used. The accessory rails 40, 42 are recessed within the area defined by the laterally extended exterior semi-octagonal shape, as defined by the end wall 28 alone when the covers 18, 20 are removed, rather than extending outwardly beyond the piece. This recessed positioning locates the posts 44 and guide channels 46 of the rail inside what would be the extended outline (generally semi-octagonal sectional shape) of the exterior sides of the half-grip piece if the exterior sides were extended in a manner similar to the end wall 28. This relationship can be seen clearly in FIG. 6.

Ventilation holes 48 are located inside the accessory rail 40 between the opposing post rows 44. Corresponding ventilation holes 50 are located in the top 22 of the cover 18. The holes are in registry with each other when the cover 18 is in place.

The covers 18, 20 engage and cover the respective rails 40, 42 when the rails are not in use. As noted above, the covers are preferably flexible, and can be formed from a heat-resistant elastomeric material. The preferred material for making the cover is an injection molded thermoplastic rubber with a hardness of between 65 and 85 Shore A.

Figure 7:
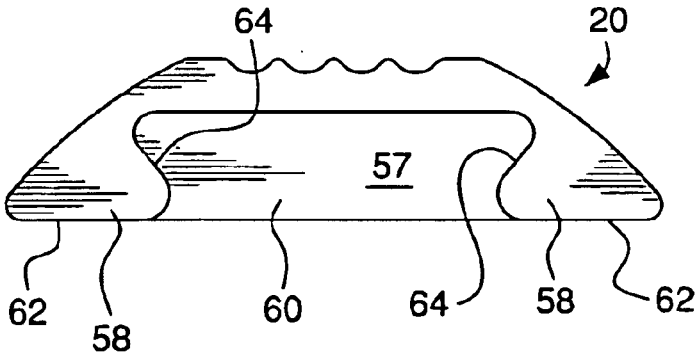
FIG. 7 is rear plan view of the cover removed in FIG. 6.

The outside of the covers can be provided with a series of recesses 52, ribs (not shown) or other formations for enhancing grip and/or providing a pleasing appearance. In addition, the generally flattened tops of the covers can be provided with a series of parallel longitudinal ribs 54, which are preferably continuous with the end wall 28. As shown in FIG. 7, looking at the rear of cover 20, i.e. the open end that abuts end wall 28, the bottom of the cover 20 is hollowed to receive the rail 42. The cover 18 is the same as cover 20 except that the front wall 57 of the cover 20 does not have an arcuate recess like the one centrally disposed in the front wall 56 of cover 18 (FIG. 3) for receiving a semi-arcuate engagement tab, which is described below. (The cover 18 also has vent holes 50, which would not be seen from the view of FIG. 7.) Lips 58 extend inwardly from the sides of the cover into the hollow 60. The lips can be substantially triangular in lateral cross-section, flat at the bottom 62 so as to be flush with the body of the half-grip piece 14 when engaged, and sloping downwardly and inwardly (into the hollow) at the interior sides 64. The configuration provides the hollow with a trapezoidal lateral cross-section, which is narrowest at its open bottom. The hollow is open at the back, where the installed cover abuts the end wall 28, but enclosed at the front 57 to conceal the front of the rails when engaged therewith. To engage the cover 20 with the rail 42, the lips 58 can deform around the rail 42 and grip in the guide channels 46'. Similarly, the cover can be deformed around the rail again to remove the cover from the rail.

Figure 8:
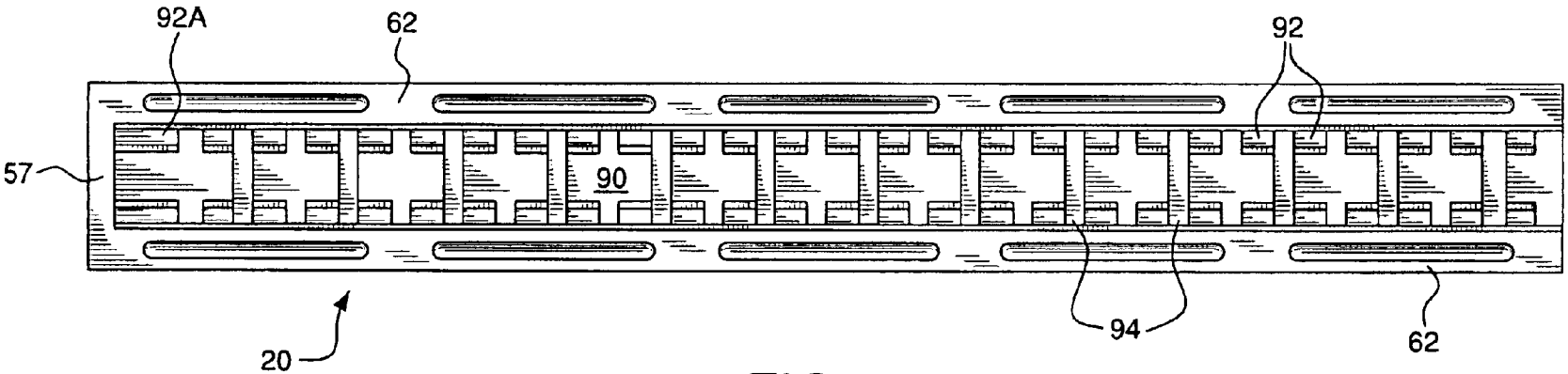
FIG. 8 is a plan view of the bottom of the cover of FIG. 7.

When the flexible rubber cover 20 is mounted on the rail 42, the lips 58 provide substantial friction against the rails in guide channels 46'. In addition, the bottom 90 of the cover top portion 24 (FIG. 8) can be molded with post engaging members for limiting longitudinal movement of the cover 20 relative to the rail 42. The post engaging members can include indentations 92 that mate with the posts 44' of the rail 42. An extended indentation 92A can be provided if the rail includes an extended post proximate the front end, as shown in FIG. 5. Thus, each of the posts can fit into an indentation 92 when the cover 2Q is installed on the rail 42. Additional post engaging members can include lateral ribs 94 in between all or some of the indentations 92. The ribs 94 can be provided in between every second set of indentations, as shown in FIG. 8, so that the vent holes 50 may be easily punched or cut from the non-ribbed areas if a cover 18 is to be produced. When mounted on the rail 42, the lateral ribs 94 are disposed between the posts 44'. A series of recesses can also be provided along the bottom surfaces 62.

Given the engagement of posts 44 with indentations 92, the position of the lateral ribs 94 and the friction provided by the rubber material, the covers will not slide longitudinally with respect to the body of the half-grip piece 14 under conditions of normal use. However, the covers can be easily removed and reinstalled by deforming the lips 48 around the rails.

The rubber covers can be used when an accessory is mounted on the rail, and cut to length to cover the portions of the rail that are not covered by the accessory. If desired, slideable rigid covers or a combination of different covers, such as those described in the above-referenced U.S. Pat. No. 6,609,321, could instead be provided.

Figure 3:
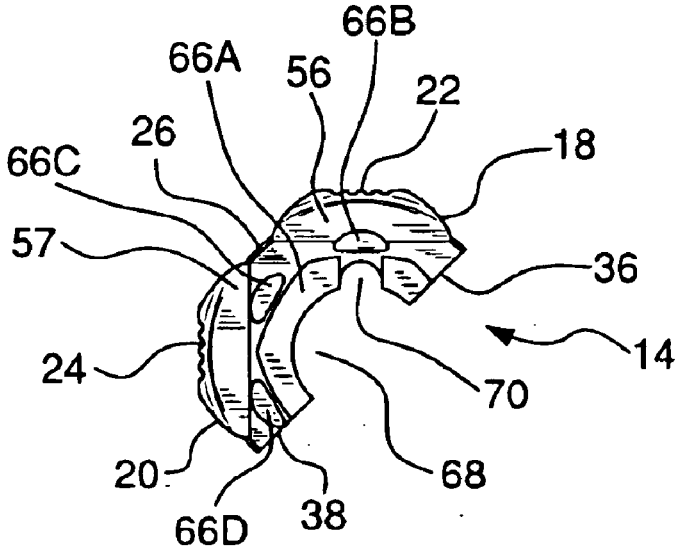
FIG. 3 is a front plan view of the half-grip piece of FIG. 2.

A generally semicircular mounting apparatus 66 extends from the front end of the half-grip piece. The mounting apparatus is configured to engage against the rifle's handguard retaining assembly (not shown). The apparatus 66 includes a half-ring 66A, which is interrupted by a slot 70, described below. The half-ring has a substantially semicircular inner diameter and a substantially polygonal outer shape, preferably a hexagonal outer shape. The apparatus further includes three semi-arcuate engagement tabs 66B, 66C, 66D. The engagement tab 66B protrudes partially above the exterior side 30, as shown in FIGS. 3 and 5.

When properly mated with an identical half-grip piece 12, The mounting apparatus 66 forms a ring with a generally hexagonal outer shape and a series of six semi-arcuate engagement tabs disposed about the ring at about 60 degree increments. This arrangement permits the handguard 10 to be mounted on a rifle equipped with either a triangular front handguard retaining ring, such as an M16A1, or a circular front handguard retaining ring, such as the M16A2.

The apparatus 66 defines a semicircular opening 68 for wrapping around the barrel 11 of the firearm. Extending from the semicircular portion of the opening is a slot 70, which interrupts half-ring 66A, for receiving the gas return tube 17 of the firearm. Such gas return tubes are conventional on rifles of the AR15/M16 family, and are shown, for example, in U.S. Pat. No. 4,663,875. The gas return tube 17 is located above the barrel 11 in the vertical plane of the rifle. The slot 70 projects from the semicircular opening at a substantially right angle to the exterior side 30. Thus, it is intended that when the handguard 10 is assembled, the slot 70 will engage the gas return tube 17 and the exterior side 30 will become the top of the handguard 10. Note that the mating surfaces 16 form substantially a 45 degree angle off the vertical plane of the firearm when the handguard 10 is properly mounted.

Figure 9:
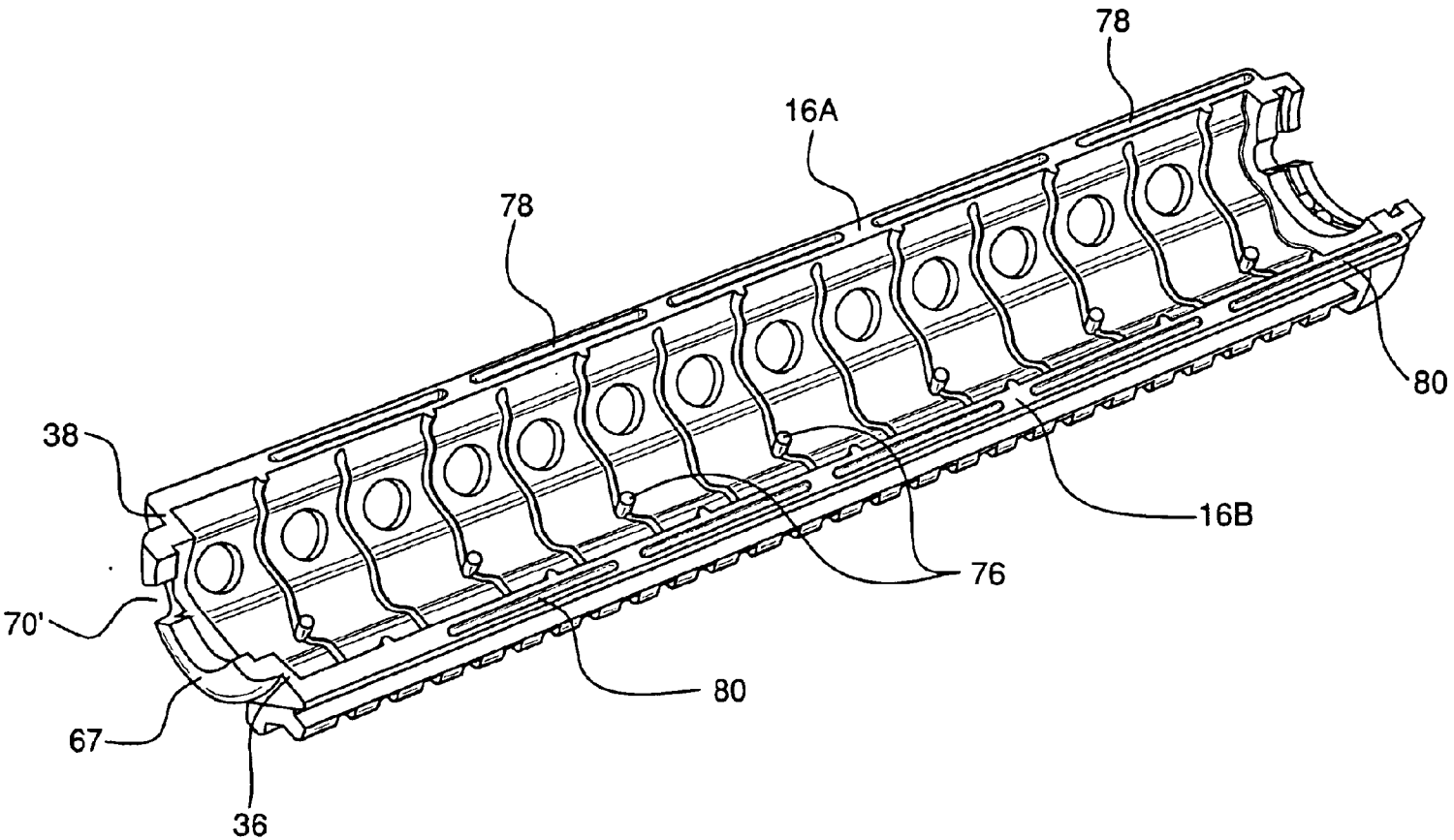
FIG. 9 is a perspective view of the interior and front of a half-grip piece equipped with an alternative engagement ring.

As shown in FIG. 9, the half-grip piece 14 can alternatively be equipped with a smooth half-ring 67, which is interrupted by a slot 70', rather than the mounting apparatus 66. The smooth half-ring 67 can be used if the handguard 10 is only to be used with a rifle equipped with a circular front handguard retaining ring. Shorter versions of the handguard 10, which can be used with carbine style rifles, can also be provided with a smooth half-ring 67.

Similar to the front end of the half-grip piece, a semicircular mounting ring 72 extends from the rear end of the half-grip, as shown in FIG. 4. This is a conventional extension to engage against the rifle's Delta ring 19, as shown in FIG. 10, except that the ring 72 has a center slot 74 for the rifle's gas return tube 17. Like the slot 70, the slot 74 is oriented transversely to the exterior surface 30.

Referring now to FIG. 9, the interior of the half-grip piece 14 may have mounting posts 76 for a metal heat shield (not depicted). The use of heat shields inside forearm handguards is well known and various configurations of shield could be used. The post 76 provide attachment points for the beat shield, which can have holes formed in it of conforming diameter, by press fitting the shield such that the posts 76 push through the holes in the shield. The half-grip piece further has longitudinally extending mounting surfaces 16A and 16B. The mounting surface 16A includes longitudinal recesses 78 for mating with corresponding longitudinal ribs 80 provided on mounting surface 16B on the other half-grip piece. In the event that the two half-grip pieces are not identical, appropriate recesses and ribs should be provided on the corresponding mounting surfaces. Alternatively, the recesses 78 and ribs 80 can be dispensed with entirely.

What is claimed is:

1. A forearm handguard for a rifle, the handguard comprising:

(a) first and second mating half-grip pieces, at least the first half-grip piece defining an elongated body having a generally triangular lateral cross-section with two exterior sides and a mating side, the exterior sides of the triangular cross-section being formed substantially at a right angle to each other, the mating side of the triangular cross-section being centrally hollowed and having outer edges that form a mating surface for mating with the other half-grip piece to enclose an air space surrounding a portion of the rifle barrel;

(b) each half-grip piece being an injection molded polymer body; and (c) at least the first half-grip piece having a longitudinally extending accessory mounting rail formed on each of the exterior sides substantially at right angles to each other and recessed in the half-grip piece such that the rails are located inside a laterally extended generally semi-octagonal outline defined by an end wall of the half-grip piece.

2. The forearm handguard of claim 1, wherein the second half-grip piece is essentially identical to the first half-grip piece.

3. The forearm handguard of claim 1 further comprising at least one cover adapted for engagement with one of the rails to cover the rail when the rail is not in use, the cover being shaped to replicate the laterally extended generally semi-octagonal outline.

4. The forearm handguard of claim 3, wherein the cover is formed of a flexible material.

5. The forearm handguard of claim 3, wherein the accessory mounting rails have two rows of opposing ribs and a guide channel along and depending under each row, and the cover plate has a pair of inwardly extending lips that deform around the rail to grip in the guide channels of the rail.

6. The forearm handguard of claim 5, wherein the accessory mounting rail is open at its front end to allow an accessory to slide onto the guide channels, and the rail terminating at a rear end against the end wall.

7. The forearm handguard of claim 1 wherein at least one end of the handguard includes a slot for receiving a gas return tube of the rifle, the slot being formed transverse to one of the exterior sides.

8. The forearm hand guard of claim 7 wherein the mating surfaces are disposed at an angle of substantially 45 degrees off a vertical plane of the rifle when the handguard is mounted on the rifle with the gas return tube received by the slot.

9. A forearm handguard for a rifle, the handguard comprising:

(a) a pair of essentially identical mating half-grip pieces, each half-grip piece defining an elongated body with a generally triangular lateral cross-section having two exterior sides and one longer side, the exterior sides of the triangular cross-section being formed substantially at a right angle to each other, the longer side of the triangular cross-section being centrally hollowed and having outer edges that form a mating surface for mating with the other half-grip piece, the two half-grip pieces forming the forearm handguard enclosing an air space surrounding a portion of the rifle barrel when so mated;

(b) each half-grip piece having a longitudinally extending accessory mounting rail formed in the lateral center of each of the exterior sides thereof;

(c) at least one end of the half-grip pieces having a semicircular opening for wrapping around the barrel of the firearm and a slot extending from the semicircular opening for receiving a gas return tube of the firearm, the slot projecting from the semicircular opening at a substantially right angle to one of the exterior sides.

10. The forearm hand guard of claim 9 further comprising a cover for each accessory mounting rail, the covers adapted for engagement with the rails to cover the rails when the rails are not in use, the covers defining a generally octagonal outer shape when the half-grip pieces are mated and the covers are engaged with the rails.

11. The forearm handguard of claim 10 wherein the covers are elastomeric.

12. The forearm handguard of claim 11 wherein each accessory mounting rail has two rows of opposing ribs and a guide channel along and depending under each row, and each cover has a-pair of lips that resiliently deform around the ribs to engage the guide channels of a respective rail.

13. The forearm handguard of claim 10, wherein each half-grip piece further comprises an end wall on at least one end thereof, the end wall defining the same generally octagonal outer shape as the covers when the covers are engaged with the rails, wherein the ends of each cover abut the end wall when so engaged.

14. The forearm handguard of claim 9 wherein the mating surfaces of the half-grip pieces are oriented at an angle of substantially 45 degrees with respect to a vertical plane through the firearm when the half-grip pieces are mated around the barrel of the firearm and the recess receives the gas return tube.

15. The forearm handguard of claim 9 wherein (a) both of the half-grip pieces have a semicircular opening for wrapping around the barrel of the firearm and a slot extending from the semicircular opening for receiving a gas return tube of the firearm, the slot projecting from the semicircular opening at a substantially right angle to one of the exterior sides, and (b) when the half-grip pieces are assembled, the semicircular openings mate to form a substantially circular opening that is surrounded by a mounting apparatus adapted to engage either a triangular front handguard retaining ring or a circular front handguard retaining ring, the mounting apparatus comprising a ring with a generally hexagonal outer shape and at least two semi-arcuate engagement tabs disposed about the ring.

16. A hand guard for a rifle comprising:

(a) a first half-grip piece comprising (i) an elongated body having a generally triangular cross section with two exterior sides and a hollow mating side, the mating side having mating surfaces adjacent the exterior sides, (ii) a longitudinally extending accessory mounting rail formed on each of the exterior sides, (iii) a cover for each of the mounting rails, (iv) a semicircular opening in at least one end of the elongated body and a slot extending from the opening toward one of the exterior surfaces; and (b) a second half grip piece comprising an elongated body with mating surfaces that correspond with those of the first half grip piece;

(c) when the first and second half-grip pieces are mounted on a rifle with a gas return tube of the rifle received in the slot, the mating surfaces are disposed at an angle of about 45 degrees off a vertical plane of the firearm.

17. The handguard of claim 16 wherein the first and second half-grip pieces are substantially identical.

18. The handguard of claim 17 wherein when the substantially identical half-grip pieces are mated, the semicircular openings mate to form a substantially circular opening that is surrounded by a mounting apparatus adapted to engage either a triangular front handguard retaining ring or a circular front handguard retaining ring, the mounting apparatus comprising a ring with a generally hexagonal outer shape and at least two semi-arcuate engagement tabs disposed about the ring.

19. The handguard of claim 17 further comprising an end wall defining a laterally extended generally octagonal outline.

20. The handguard of claim 19 wherein the covers are elastomeric covers.

21. The handguard of claim 20 wherein when the covers are mounted on the mounting rails, the covers and exposed surface of the elongated body substantially replicate the laterally extended generally octagonal outline along more than half of the length of the handguard.

* * * * *